United States Patent [19]

Gillespie et al.

[11] 3,977,796

[45] Aug. 31, 1976

[54] BODY SCRUBBER HAVING END GRIPS

[75] Inventors: Roland A. Gillespie; Minnie M. Gillespie, both of Eureka, Utah

[73] Assignee: The Raymond Lee Organization, Inc., New York, N.Y. ; a part interest

[22] Filed: Mar. 31, 1975

[21] Appl. No.: 563,654

[52] U.S. Cl. ..... 401/8; 15/222; 401/201

[51] Int. Cl.[2] ..... A47K 7/03

[58] Field of Search ..... 15/208, 209 B, 222, 15/104.94; 401/8, 201; 428/255

[56] References Cited

UNITED STATES PATENTS

| | | | |
|---|---|---|---|
| 2,730,745 | 1/1956 | Norman | 15/222 X |
| 3,364,511 | 1/1968 | Martin | 15/222 |
| 3,674,374 | 7/1972 | Jennings | 401/8 |
| 3,761,991 | 10/1973 | Moss | 15/209 B |
| 3,812,849 | 5/1974 | Guinta | 15/222 |

FOREIGN PATENTS OR APPLICATIONS

| | | | |
|---|---|---|---|
| 1,228,894 | 3/1960 | France | 15/222 |
| 1,079,672 | 8/1967 | United Kingdom | 15/222 |

*Primary Examiner*—Daniel Blum
*Attorney, Agent, or Firm*—Daniel Jay Tick

[57] ABSTRACT

Two pieces of nylon net of predetermined dimensions are superimposed on a piece of terry cloth of the predetermined dimensions. The terry cloth and nylon combination is folded over on itself to form a strip-like configuration in a manner whereby the net is on the outside. Each of a pair of handle members is affixed to a corresponding end of the strip-like configuration of terry cloth and nylon.

1 Claim, 4 Drawing Figures

BODY SCRUBBER HAVING END GRIPS

DESCRIPTION OF THE INVENTION

The present invention relates to a body scrubbing device.

Objects of the invention are to provide a body scrubbing device of simple structure, which is inexpensive in manufacture, stored and used with facility and convenience, and functions efficiently, effectively and reliably to scrub a selected part of the body with soapy water, plain water or moist or dry friction.

In order that the invention may be readily carried into effect, it will now be described with reference to the accompanying drawing, wherein.

In the FIGS., the same components are identified by the same reference numerals.

The body scrubbing device of the invention comprises a piece of terry cloth 1 (FIG. 1) of predetermined dimensions such as, for example, 29 by 14 inches.

Figure 4:
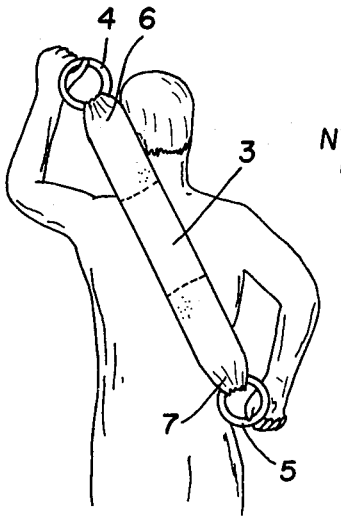
FIG. 4 is a view of the embodiment of FIG. 3 in use.
Figure 1:
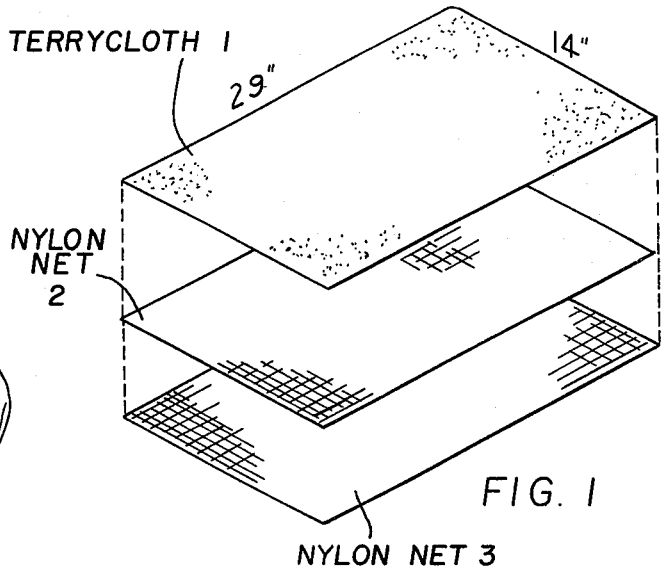
FIG. 1 is an exploded view of the components of the body scrubbing device of the invention.
Figure 2:
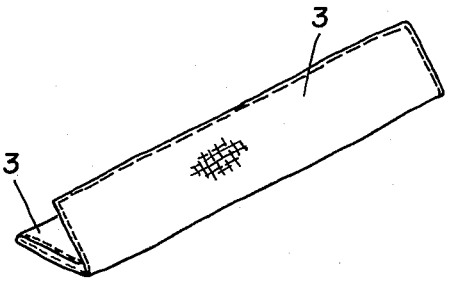
FIG. 2 is a view of the components of FIG. 1 in a combination folded over on itself to form a strip-like configuration.
Figure 3:
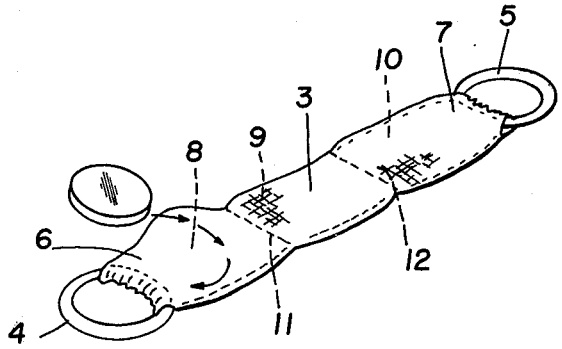
FIG. 3 is a view of an embodiment of the body scrubbing device of the invention.

Two pieces of nylon net 2 and 3 of the predetermined dimensions are superimposed on the terry cloth, as shown in FIG. 1. The terry cloth and nylon combination is folded over twice upon itself, as shown in FIG. 2, to form a substantially strip-like configuration, as shown in FIGS. 3 and 4, in a manner whereby the net 3 is on the outside.

A pair of identical handle members 4 and 5 preferably comprise plastic rings. The handle member 4 is affixed to an end 6 of the strip-like configuration of terry cloth and nylon, as shown in FIGS. 3 and 4. The handle member 5 is affixed to the end 7 of the strip-like configuration of terry cloth and nylon, as shown in FIGS. 3 and 4.

The handle members 4 and 5 are affixed to the strip-like configuration of terry cloth and nylon by any suitable means such as, for example, by sewing them into said configuration, as shown and described in British Pat. No. 1,079,672.

A plurality of pockets 8, 9 and 10 (FIG. 3) are formed in the strip-like configuration by sewing cross seams 11 and 12 therein. The pockets 8, 9 and 10 may be used for holding soap therein whereby the user may soap himself with the device.

The terry cloth functions to retain pieces of soap from passing through the nylon net.

While the invention has been described by means of a specific example and in a specific embodiment, we do not wish to be limited thereto, for obvious modifications will occur to those skilled in the art without departing from the spirit and scope of the invention.

We claim:

1. A body scrubbing device, comprising a piece of terry cloth of predetermined dimensions;

two pieces of nylon net of the predetermined dimensions superimposed on the terry cloth, the terry cloth and nylon combination being folded over twice upon itself to form a substantially strip-like configuration in a manner whereby the net is on the outside;

a pair of handle members each affixed to a corresponding end of the strip-like configuration of terry cloth and nylon, each of the handle members comprising a plastic ring; and transverse stitching forming pockets in the strip-like configuration for holding soap therein whereby a user may soap himself with the device.

* * * * *